US009388625B2

(12) United States Patent
Hiraoka

(10) Patent No.: US 9,388,625 B2
(45) Date of Patent: Jul. 12, 2016

(54) SAFE

(71) Applicant: Takaaki Hiraoka, Tokyo (JP)

(72) Inventor: Takaaki Hiraoka, Tokyo (JP)

( * ) Notice: Subject to any disclaimer, the term of this patent is extended or adjusted under 35 U.S.C. 154(b) by 0 days.

(21) Appl. No.: 14/388,168

(22) PCT Filed: Oct. 22, 2012

(86) PCT No.: PCT/JP2012/077186

§ 371 (c)(1),
(2) Date: Sep. 25, 2014

(87) PCT Pub. No.: WO2013/150675

PCT Pub. Date: Oct. 10, 2013

(65) Prior Publication Data

US 2015/0083031 A1 Mar. 26, 2015

(30) Foreign Application Priority Data

Apr. 5, 2012 (JP) ..... 2012-086023

(51) Int. Cl.

| | |
|---|---|
| ***E05G 1/14*** | (2006.01) |
| ***B02C 18/22*** | (2006.01) |
| ***E05G 1/02*** | (2006.01) |
| ***E05G 1/10*** | (2006.01) |

(Continued)

(52) U.S. Cl.

CPC ..... *E05G 1/14* (2013.01); *B02C 18/2225* (2013.01); *E05G 1/02* (2013.01); *E05G 1/10* (2013.01); *B02C 2018/0015* (2013.01); *B02C 2018/0023* (2013.01); *E05G 1/04* (2013.01); *Y10T 70/7068* (2015.04)

(58) Field of Classification Search

CPC ..... E05G 1/00; E05G 1/14; E05G 2700/04; E05G 1/02; E05G 1/04; E05G 1/10; B02C 18/2225; B02C 18/00; B02C 2018/0023; B02C 2018/0015; Y10T 70/7068

USPC ..... 109/25, 29–34, 38–42, 23; 241/63, 98; 221/30, 71

See application file for complete search history.

(56) References Cited

U.S. PATENT DOCUMENTS

| | | | | |
|---|---|---|---|---|
| 3,559,593 | A * | 2/1971 | Munton et al. | 109/25 |
| 3,654,880 | A * | 4/1972 | Schesso | 109/25 |
| 4,853,676 | A * | 8/1989 | Kitts | 340/543 |

(Continued)

FOREIGN PATENT DOCUMENTS

| | | |
|---|---|---|
| JP | 9-184363 | 7/1997 |
| JP | 2006-338218 | 12/2006 |

OTHER PUBLICATIONS

"Bellows." Wiktionary.org. 2007. https://web.archive.org/web/20071029051301/http://en.wiktionary.org/wiki/bellows. Feb. 5, 2016.*

(Continued)

*Primary Examiner* — Lloyd Gall
*Assistant Examiner* — Amanda L Miller
(74) *Attorney, Agent, or Firm* — Andrew F. Young, Esq.; Lackenbach Siegel, LLP

(57) ABSTRACT

A safe is provided capable of destruction of stored materials upon occurrence of a theft indication. A storage part stores a recording medium by a retaining means or system, and a destroying means or system that is operative to destroy the recording medium upon an activation is also within the storage part. A theft detecting part detects unauthorized access and a driver drives the destroying means or system for destruction.

13 Claims, 5 Drawing Sheets

(51) Int. Cl.
*B02C 18/00* (2006.01)
*E05G 1/04* (2006.01)

(56) References Cited

U.S. PATENT DOCUMENTS 5,479,341 A * 12/1995 Pihl et al. ..... 700/79
5,918,554 A * 7/1999 Rassamni ..... E05G 1/12 109/29
6,276,621 B1 * 8/2001 Henry ..... B02C 18/0007 241/100
6,510,804 B1 * 1/2003 Negoro ..... 109/25
6,724,304 B2 * 4/2004 Risi ..... 340/540
6,799,737 B1 * 10/2004 Bargert ..... B02C 18/0007 241/101.2
8,465,473 B2 * 6/2013 Horvath ..... A61B 17/32002 200/86.5
2002/0029728 A1 * 3/2002 Walker ..... E05G 1/14 109/25
2002/0056986 A1 * 5/2002 Shafer ..... B42D 1/08 281/38
2004/0007544 A1 * 1/2004 MacKelvie ..... 211/40
2005/0049747 A1 * 3/2005 Willoughby ..... A61J 7/0084 700/232
2005/0051448 A1 * 3/2005 Miles et al. ..... 206/459.1
2007/0034725 A1 * 2/2007 Duh ..... B02C 18/0007 241/236
2010/0032332 A1 * 2/2010 Davis et al. ..... 206/459.1
2011/0221850 A1 * 9/2011 Kawaguchi ..... B41J 11/006 347/179
2013/0320121 A1 * 12/2013 Ko ..... 241/63

OTHER PUBLICATIONS

PCT/JP2012/077186 International Search Report mailed Nov. 13, 2012, 1 page—English, 1 page—Japanese.
PCT/JP2012/077186 Written Opinion of the ISR mailed Nov. 13, 2012, 3 pages—English, 3 pages—Japanese.

* cited by examiner

SAFE

CROSS REFERENCE TO RELATED APPLICATIONS

This application relates to and claims priority from International App. Ser. No. PCT/JP2012/077186 filed Oct. 22, 2012, the entire contents of which are incorporated herein by reference, and which in turn claims priority from JP Ser. No. 2012-086023 filed Apr. 5, 2012.

FIGURE SELECTED FOR PUBLICATION

FIG. 3

BACKGROUND OF THE INVENTION

1. Field of the Invention

The present invention relates to a safe for storing a recording medium, and more particularly to a safe with destroying means for destroying a recording medium upon detecting a theft.

2. Description of the Related Art

Valuable information is recorded on a recording medium such as CD, DVD, a flash memory, film and card, and for such purpose, a safe for keeping such recording media recorded with valuable information is desired. Normally, safes are intended to keep papers such as cash, securities and bankbooks, but a recording medium can also be kept in a normal safe used for papers since they are often made light and thin.

In a normal safe for keeping papers such as banknotes, a safe is known to prevent a theft by spraying ink to banknotes stored inside the safe to make the stored articles unusable when encountering a theft. An example of such a safe is disclosed in patent literature 1 noted below.

CITATION LIST

Patent Literature

Patent Literature 1: Japanese Published Unexamined Patent Application No. 2006-338218*

ASPECTS AND SUMMARY OF THE INVENTION

In response, it is now recognized that an improved safe and safe system is provided to address at least one of the concerns noted herein.

SUMMARY OF THE INVENTION

Technical Problem

As conventional safes are solely intended for keeping papers such as banknotes, spraying of ink onto stored articles to make the articles unusable is employed for anti-theft purpose. However, in case of a recording medium, they do not always become unusable by spraying ink, and therefore information recorded on the recording medium cannot be said to be lost completely by such measures. Thus, such measures are considered insufficient as an anti-theft means.

The present invention is provided reflecting on the above mentioned problem, and it is an object of the present invention to provide a safe that ensures the information stored in the recording medium is lost in case of theft occurrence.

Solution to the Problem

To solve the above mentioned problem, a safe of the present invention comprises an openable and closable storage part for accommodating a recording medium retained by a retaining means and a destroying means capable of destroying the recording medium accommodated in the storage part along with the retaining means, wherein the safe further comprises a theft detecting means for detecting unauthorized access to the storage part and a driving means for driving the destroying means, and when unauthorized access to the storage part is detected, the theft detecting means activates the driving means to destroy the recording medium accommodated in the storage part together with the retaining means.

Further, the destroying means of the safe of the present invention includes a shredder for rupturing the recording medium together with the retaining means.

Still further, the retaining means of the safe of the present invention includes a plurality of retaining parts for the recording medium along a longitudinal direction, wherein the retaining parts are folded at both sides of the longitudinal direction to form a bellows and accommodated within the storage part.

Still further, the storage part of the safe of the present invention includes a guiding part for guiding the retaining means toward the destroying means, with the retaining means arranged so as its end part is placed over the guiding means.

Further, the guiding part of the safe of the present invention includes a communication part for communicating between the storage part and the destroying means, and a supporting part for supporting the retaining means heading toward the communication part.

Furthermore, the safe of the present invention further includes a lock means for locking the storage part, and when an abnormality of the lock means is detected, the theft detecting means determines it as unauthorized access to the storage part.

Further, the lock means of the safe of the present invention includes an input part for entering a password, and when a wrong password is entered into the input part more than a prescribed number of times, the theft detecting means determines it as an abnormality of the lock means.

Furthermore, the safe of the present invention further includes a horizontal or horizon detecting part for detecting inclination angle, and when the horizontal detecting part detects an inclination exceeding a prescribed angle, the theft detecting means or system determines this as an unauthorized access to the storage part.

The safe of the present invention further includes a feeding part supplied with power externally and a power storage part charged by the feeding part, and when residual electric charge of the power storage part is reduced below a prescribed amount, the theft detecting means or system determines it as unauthorized access to the storage part.

Advantageous Effects of the Invention

According to the safe of the present invention, as it comprises the theft detecting means or system for detecting unauthorized access to the storage part, wherein the theft detecting means or system activates the driving means or system to destroy the recording medium along with the retaining means or system accommodated in the storage part by the destroying means or system when detecting unauthorized access to the storage part, and by physically destroying the recording medium, it ensures that the information stored in the recording medium is lost upon theft occurrence and prevents information to be stolen.

Further, according to the safe of the present invention, it is possible for the recording medium to be destroyed for sure with a simple means or system by configuring the destroying means or system with a shredder for rupturing the recording medium along with the retaining means or system.

Furthermore, according to the safe of the present invention, it is possible to accommodate the recording medium efficiently by the retaining means or system and also to destroy the recording medium continuously and efficiently, as the retaining means or system is formed with a plurality of retaining parts for the recording medium along the longitudinal direction, while the retaining parts are folded at both sides of the longitudinal direction to form a bellows and accommodated within the storage part.

Further, according to the safe of the present invention, it is possible to start destruction of the recording medium immediately upon detecting a theft, as the storage part is formed with the guiding part to guide the retaining means or system to the destroying means or system and the end part of the retaining means or system is placed over the guiding part.

Furthermore, according to the safe of the present invention, it is possible to guide the retaining means or system retaining the recording medium smoothly to the destroying means or system; as the guiding part is formed with the communication part for communicating the storage part and the destroying part, and the supporting part for supporting the retaining means or system heading toward the communication part.

Further, according to the safe of the present invention, it is possible to detect a theft for sure; because the safe further includes the lock means or system for locking the storage part, when detecting abnormality in the lock means or system, the theft detecting means or system determines it as unauthorized access to the storage part, and the lock means or system has to be destroyed in order to fraudulently open the storage part.

Still more, according to the present invention, it is possible to detect a theft without fail even in cases when the lock means or system is not physically destroyed, as the lock means or system is formed with an input part for entering a password, and when an invalid password is entered into the input part more than a prescribed times, the theft detecting means or system determines it as an abnormality of the lock means or system.

Furthermore, according to the safe of the present invention, it is possible to detect the safe to be carried out and thus more certainly detect a theft, as the safe further comprises a horizontal detecting part for detecting inclination angle, and when the horizontal detecting part detects inclination exceeding a prescribed angle, the theft detecting means or system determines it as unauthorized access to the storage part.

Further, according to the safe of the present invention, it is possible to detect the safe being carried out and thus more reliably detect a theft, as the safe further comprises the feeder part supplied with power externally and the power storage part charged by the feeder part, and when residual electric charge of the power storage part is reduced below a prescribed amount, the theft detecting part is determines it as unauthorized access to the storage part.

The above and other aspects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
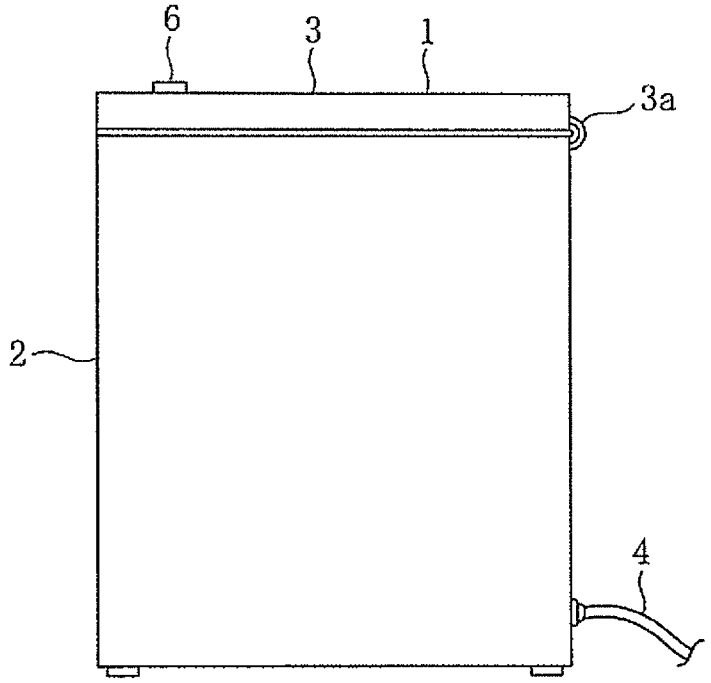
FIG. 1 is a front view of a safe according to the present embodiment.

Reference will now be made in detail to embodiments of the invention. Wherever possible, same or similar reference numerals are used in the drawings and the description to refer to the same or like parts or steps. The drawings are in simplified form and are not to precise scale. The word 'couple' and similar terms do not necessarily denote direct and immediate connections, but also include connections through intermediate elements or devices. For purposes of convenience and clarity only, directional (up/down, etc.) or motional (forward/back, etc.) terms may be used with respect to the drawings. These and similar directional terms should not be construed to limit the scope in any manner. It will also be understood that other embodiments may be utilized without departing from the scope of the present invention, and that the detailed description is not to be taken in a limiting sense, and that elements may be differently positioned, or otherwise noted as in the appended claims without requirements of the written description being required thereto.

Various operations may be described as multiple discrete operations in turn, in a manner that may be helpful in understanding embodiments of the present invention; however, the order of description should not be construed to imply that these operations are order dependent. It should also be understood that as used herein means or system language is effective a system language.

Now, embodiments of the present invention are explained in detail along with the drawings. Referring to FIG. 1, a front view of a safe 1 according to the present embodiment is illustrated. The safe 1 of the present embodiment comprises a main body 2 provided with a lid part 3 attached openably/closably via a hinge part 3*a*, and a power supply cord 4 to be connected to an external power supply extending from the main body 2. The lid part 3 may be locked or unlocked to the main body 2, and by locking the lid part 3 to the main body 2, articles stored inside the safe 1 cannot be taken out. A gripping part 6 is provided on the top surface of the lid part 3, and the lid part 3 can be opened by lifting up the gripping part 6 when the lid part 3 is in an unlocked state.

Figure 2:
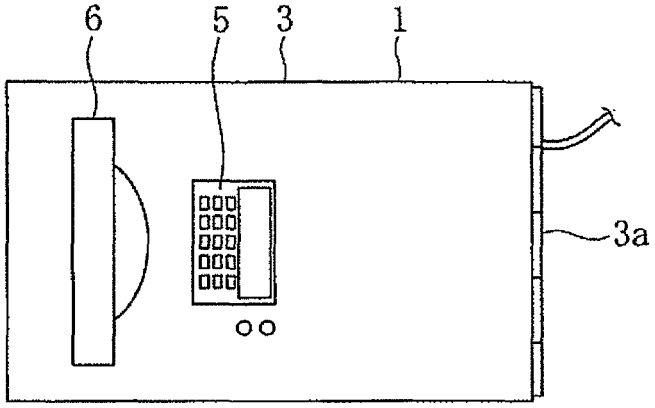
FIG. 2 is a plane view of the safe.

Referring to FIG. 2, a plane view of the safe 1 is illustrated. As shown in the drawing, an input part 5 for entering a password for unlocking the lock is provided on the lid part 3. By entering a preset valid password to the input part 5, the lock of the lid part 3 is released to enable opening of the lid part 3 to take out the articles stored inside the safe 1.

Figure 3:
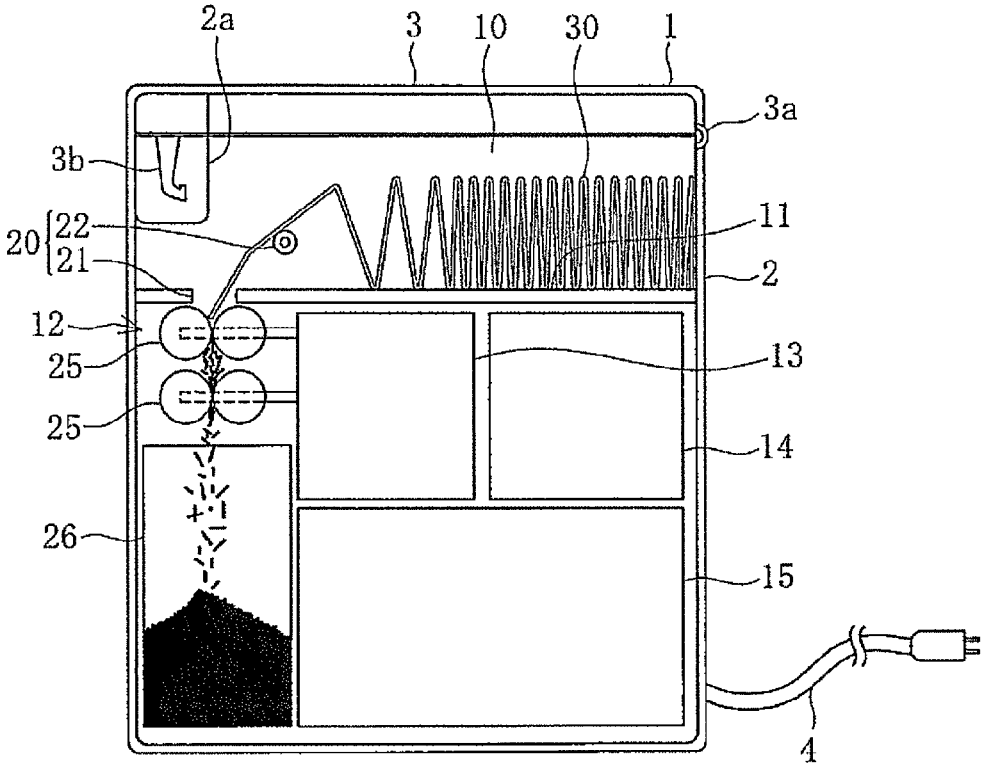
FIG. 3 is a schematic sectional view illustrating the inner structure of the safe.

Referring to FIG. 3, a schematic sectional view illustrating the inner structure of the safe 1 is shown. In the main body 2 of the safe 1, a hollow storage part 10 which is openable/closable with a lid part 3 formed on top is provided, and inside the storage part 10, a recording medium retained by a retaining means or system 30 is accommodated. In the present embodiment, CDs (compact disks) are intended as the recording media to be stored. However, the recording media shall not be limited to CDs, and any other recording media, such as DVDs and other optical recording media, memory cards, magnetic cards and microfilms used as a means or system for recording information, can be stored.

In the safe 1, section below the storage part 10 is divided by a bottom surface part 11. In the section below the bottom surface part 11, a destroying means or system 12 for rupturing and destroying the recording medium retained by the retaining means or system 30, a driving means or system 13 for driving the destroying means or system 12, a horizontal detecting part 14 for detecting the inclination state of the safe 1 and a power storage part 15 for supplying power to electrical operations inside the safe 1 are provided. The power storage part 15 is connected to the power supplying cord 4 and charged by an external power source.

A lock part 3*b* is formed on the distal end of the opening part of the lid part 3, and a locked part 2*a* engageable with the lock part 3*b* is formed on the corresponding position of the main body 2. The lock part 3*b* of the lid part 3 engages with the locked part 2*a* of the main body 2 when the lid part 3 is in a closed state, and locks so as to maintain the engaging state even when a force is applied. As described above, the lock is released only when the valid password is entered to the input part 5. Further, a lock detecting sensor (not shown) for detecting the engaging state with the locked part 2*a* is provided to the lock part 3*b* to detect whether the lid part 3 is closed or not.

The destroying means or system 12 is configured as a shredder which shreds an object inserted between cutting parts 25 arranged adjacently opposed to each other. In the present embodiment, 2 sets of cutting parts 25 arranged adjacently opposed to each other are provided on top and bottom as shown in FIG. 3, and they are rotated by the driving means or system 13 including a motor to shred the recording medium retained by the retaining means or system 30. A shredded material receiving part 26 for accommodating shredded material is provided below the destroying means or system 12.

Figure 4:
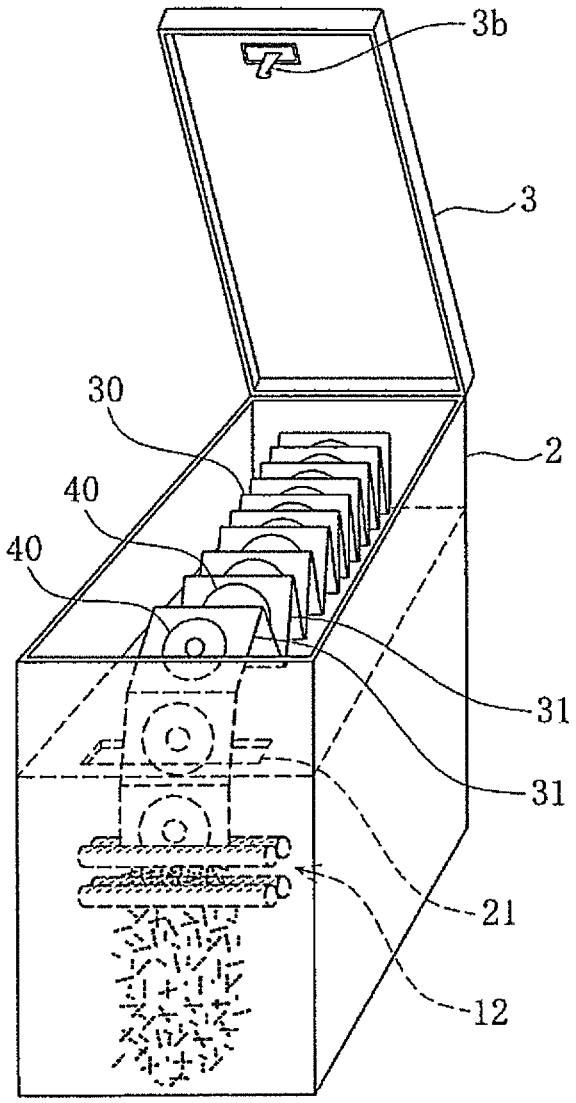
FIG. 4 is a perspective view of the safe with its lid part opened.

Now, structure of the retaining means or system 30 is described in detail. Referring to FIG. 4, a perspective view of the safe with the lid part 3 in an opened state is illustrated. The retaining means or system 30 is provided with numerous retaining parts 31 for retaining recording media 40 along a longitudinal direction, and each retaining part is folded back at both sides in the longitudinal direction to form a bellows as a whole. Each retaining parts 31 is formed as a pocket to accommodate a single recording medium 40. The retaining means or system 30 comprises a plurality of retaining parts 31 formed by adhering a transparent or translucent resin material on the surface side and a nonwoven fabric on the rear surface side. However, the material of the retaining means or system 30 is not limited to above.

The retaining means or system 30 with numerous retaining parts 31 arranged along the longitudinal direction while folded back to form a bellows so that it becomes possible to accommodate numerous recording media 40 and the recording media 40 can be gathered in a single belt-like member, and therefore a shredding of the recording media by the destroying means or system 12 can be continuously conducted.

As illustrated in FIGS. 3 and 4, a slit-like communication part 21 is formed on the bottom part dividing the storage part 10 and the lower section within the safe 1, and the end part of the retaining means or system 30 retaining the recording medium 40 is set at the cutting part 25 of the destroying means or system 12. Within the storage part 10, a supporting part 22 for supporting the proximity of the end part of the retaining means or system 30 is provided. A guiding part 20 for guiding the retaining means or system 30 smoothly to the destroying means or system 12 comprises the communicating part 21 and the supporting part 22 together. Upon detecting unauthorized access to the storage part 10 in the safe 1, the retaining means or system 30 accommodating the recording medium 40 guided to the destroying means or system 12 by the guiding means or system 20 can be immediately initiated to be shredded.

Multiple means or systems can be considered as a means or systems to detect unauthorized access to the storage part 10 in the safe 1. A theft detecting means or system (not shown) is provided inside the safe 1, and such theft detecting means or system monitors multiple states to determine presence or absence of unauthorized access to the storage part 10. When the theft detecting means or system determines that unauthorized access to the storage part 10 is present due to the change in one of the multiple states under observation, it operates to conduct shredding of the recording medium 40 by the destroying means or system 12.

As described above, the horizontal detecting part 14 is installed inside the safe 1. Information on the inclination state of the safe 1 is sent from the horizontal detecting part 14 to the theft detecting means or system 12. When the horizontal detecting part 14 detects the safe 1 to be inclined more than a prescribed angle, and the theft detecting means or system determines that the storage part 10 is illegally accessed by a theft, the theft detecting means or system activates the driving means or system 13 to shred the retaining means or system 30 retaining the recording medium 40 by the destroying means or system 12.

Further, the theft detecting means or system monitors residual electric charge of the power storage part 15. In a normal state, the power storage part 15 maintains substantially full charge as the power supplying cord 4 is connected to the external power supply, but in occurrence of theft, the power supplying cord 4 is removed from the external power supply and the residual electric charge of the power storage part 15 gradually is reduced. When the residual electric charge of the power storage part 15 becomes less than a prescribed amount, the theft detecting means or system determines that the storage part 10 is accessed illegally by a theft, and activates the driving means or system 13 to shred the retaining means or system 30 retaining the recording medium 40 by the destroying means or system 12.

The theft detecting means or system also monitors the lock detecting sensor provided on the lock part 3*b* of the lid part 3. When the lock detecting sensor detects that the locked state of the lock part 3*b* is released by other than the event of entering a valid password to the input part 5, the theft detecting means or system determines that the storage part 10 is illegally accessed by a theft and then activates the driving means or system 13 to shred the retaining means or system 30 retaining the recording medium 40 by the destroying means or system 12.

Furthermore, the theft detecting means or system monitors entry of a password by the input part 5. When an invalid password is entered to the input part 5 instead of the valid password more than prescribed times, the theft detecting means or system determines that the storage part 10 is illegally accessed by a theft and then activates the driving means or system 13 to shred the retaining means or system 30 retaining the recording medium 40 by the destroying means or system 12.

As described above, by monitoring multiple states by the theft detecting means, and activating the driving means or system 13 to shred and destroy the retaining means or system 30 retaining the recording medium 40, if any states indicate unauthorized access to the storage part 10, it is possible to detect theft without fail and reliably erase the recorded information by destroying the recording medium 40 upon theft occurrence. It is thereby possible to surely prevent the information kept in the safe 1 from being stolen.

According to the present embodiment, the input part 5 is provided to the lid part 3 of the safe 1 to enter a password to the input part 5. On the other hand, a function of the input part 5 can be provided to a smartphone so that a safe with higher security performance can be provided. A perspective view of a safe 1 comprising a smartphone as the input part 5 is illustrated in FIG. 5.

Figure 5:
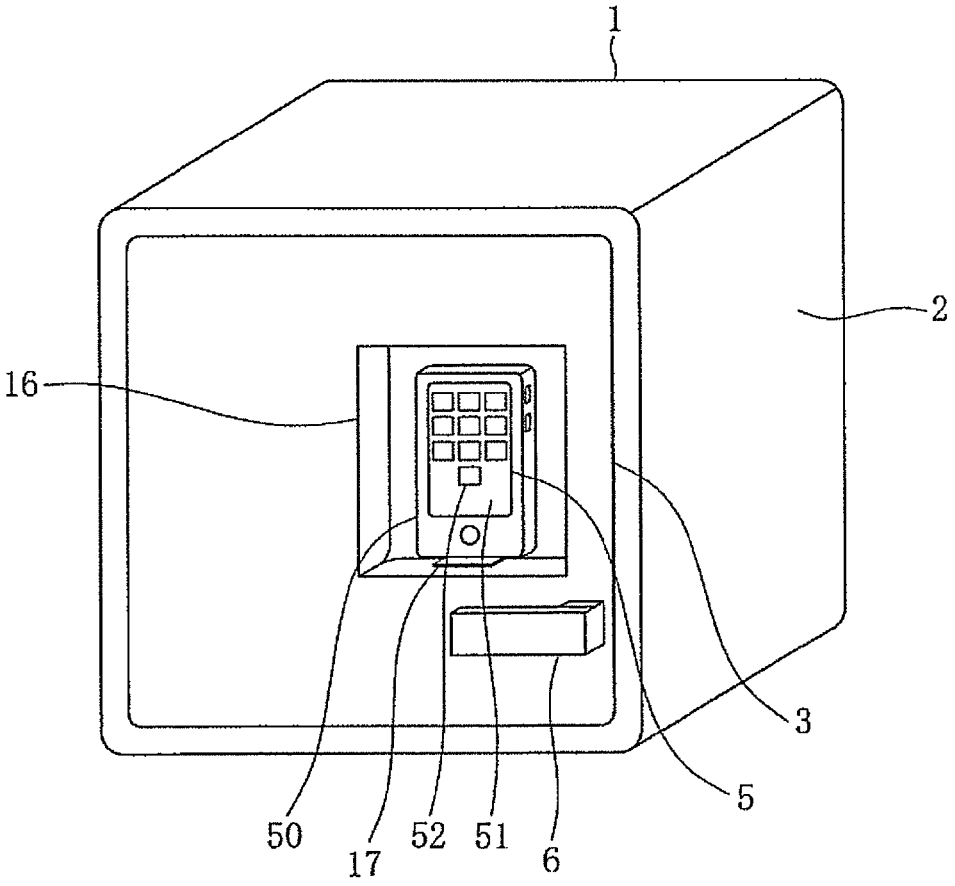
FIG. 5 is a perspective view of the safe with its input part constructed of an exemplary smart phone.

Referring to FIG. 5, a recessed part 16 for accommodating smartphone 50 is provided on the lid part 3 of the safe 1, and a connecting part 17 connectable with a connection terminal of the smartphone 50 is provided on the lower surface of the recessed part 16. The smartphone 50 includes a connection terminal at the bottom, allowing to be retained in the recessed part 16 of the lid part 3 by inserting the connecting part 17 for connection.

An application to function as the input part 5 is installed in the smartphone 50 in advance. By starting the application, a screen 51 constructed with a touch panel displays an icon 52 for input, and an input can be carried out by touching the screen.

The smartphone 50 is assigned with a specific identification code, and the specific identification code assigned to the user's smartphone 50 installed with the application is stored in the safe 1 in advance. When the smartphone 50 is connected to the connecting part 17, the application sends the specific identification code assigned to the smartphone 50 to the safe 1, and the safe 1 discriminates whether the code is identical to the stored identification code or not. The safe 1 releases the locked state of the lid part 3 or locks the lid part 3 only when the identification code is identical to the recorded identification code and a valid password is entered from the smartphone 50.

From such structure, even if a smartphone other than the user's smartphone 50 is connected and the valid password is entered, the safe 1 cannot be locked and/or released unless the identification code meets to the stored identification code. Therefore, even if the password is leaked, the safe 1 could not be opened by anyone else without the smartphone 50 of the user, and it is possible to provide a safe 1 with even higher security.

While the embodiments of the present invention are described above, application of the present invention shall not be limited to the present embodiment and various applications shall be construed within the scope of its technical aspect. For example, the destroying means or system 12 shall not be limited to a shredder and anything else capable of physically destroying the recording medium 40 along with the retaining means or system 30 can be used. Further, any means or system other than the described can be used as a means or system for detecting a theft.

DESCRIPTION OF THE REFERENCES

1 Safe
2 Main body
3 Lid part
4 Power supply cord
5 Input part
6 Gripping part
10 Storage part
11 Bottom surface part
12 Destroying means or system
13 Driving means or system
14 Horizontal detecting part
15 Power charge part
20 Guiding part
21 Communication part
22 Supporting part
25 Cutting part
26 Shredded material receiving part
30 Retaining means or system
31 Retaining part
32 Folded part
40 Recording medium Having described at least one of the preferred embodiments of the present invention with reference to the accompanying drawings, it will be apparent to those skills that the invention is not limited to those precise embodiments, and that various modifications and variations can be made in the presently disclosed system without departing from the scope or spirit of the invention. Thus, it is intended that the present disclosure cover modifications and variations of this disclosure provided they come within the scope of the appended claims and their equivalents. For example, while the word 'means' is used herein, the mechanical functional details would be sufficient upon consideration of the present application, for one of skill in the art to construct a functional and operative device. Thus, particular gearing, shredding, hinge construction, door handle arrangements, etc. are sufficiently enabled for one of skill in the art. For a similar example the 'means' for action will also be understood as a system or systems operative for conducting the action, without extending beyond the scope and spirit of the present invention.

What is claimed is:

1. A safe, comprising;

a recording medium;

a retaining system;

an openable and closable storage part operative for accommodating the recording medium retained by the retaining system, the retaining system comprising:

a plurality of retaining parts for retaining said recording medium along a longitudinal direction, said retaining parts being folded and extending along the longitudinal direction to form a continuously interlinked ribbon that is formed as a bellows and accommodated fully within said storage part;

a destroying system capable of destroying said recording medium accommodated in the storage part along with said retaining system;

a theft detecting system for detecting an attempted unauthorized access to said storage part and a driving system for driving said destroying system during a use thereof; and upon a detection of said attempted unauthorized access to said storage part, said theft detecting system activating said driving system to destroy said recording medium accommodated in said storage part along with said retaining system;

a feeding part supplied with power via an external power source and a power storage part charged by the feeding part, and when a residual electric charge of the power storage part becomes lower than a prescribed amount, said theft detecting system determines that there is an unauthorized access to said storage part; and a horizontal detecting part for detecting an inclination angle of the safe, and when the horizontal detecting part detects that the inclination angle exceeds a prescribed angle, wherein said theft detecting system determines that there is an unauthorized access to said storage part.

2. The safe according to claim 1, wherein:
said destroying system further comprises:
a shredder for rupturing said recording medium along with said retaining system as said bellows.

3. The safe according to claim 1, wherein:
said storage part further comprises:
a guiding part for guiding said retaining system toward said destroying system; and
an end part of said retaining system is placed over said guiding part.

4. The safe according to claim 3, wherein:
said guiding part further comprises: a communication part for communicating between said storage part and said destroying system, and a supporting part for supporting said retaining system heading toward the communicating part.

5. The safe according to claim 1, further comprising:
a lock system for locking said storage part; and
upon detecting abnormality of said lock system, said theft detecting system determines that there is an unauthorized access to the storage part.

6. The safe according to claim 5, wherein:
said lock system further comprises:
an input part for entering a password, and when upon invalid passwords are entered in the input part more than a prescribed number of times, said theft detecting system determines that there is an abnormality of said lock system.

7. A safe, comprising:
a recording medium;
a retaining system;
an openable and closable storage part operative for accommodating the recording medium retained by the retaining system, the retaining system comprising:
a plurality of retaining parts for retaining said recording medium along a longitudinal direction, said retaining parts being folded and extending along the longitudinal direction to form a continuously interlinked ribbon that is formed as a bellows and accommodated fully within said storage part;
a destroying system capable of destroying said recording medium accommodated in the storage part along with said retaining system;
said safe, further comprising:
a theft detecting system for detecting an attempted unauthorized access to said storage part and a driving system for driving said destroying system during a use thereof;
upon a detection of said attempted unauthorized access to said storage part, said theft detecting system activating said driving system to destroy said recording medium accommodated in said storage part along with said retaining system; and
said destroying system further comprising:
a shredder for rupturing said recording medium along with said retaining system.

8. The safe according to claim 7, wherein:
said storage part further comprises:
a guiding part for guiding said retaining system toward said destroying system, and an end part of said retaining system is placed over said guiding system.

9. The safe according to claim 8, wherein:
said guiding part further comprises: a communication part for communicating between said storage part and said destroying system, and a supporting part for supporting said retaining system heading toward the communicating part.

10. The safe according to claim 9, further comprising:
a lock system for locking said storage part; and
upon detecting abnormality of said lock system, said theft detecting system determines that there is an unauthorized access to the storage part.

11. The safe according to claim 10, wherein:
said lock system further comprises:
an input part for entering a password, and when upon invalid passwords are entered in the input part more than prescribed number of times, said theft detecting system determines that there is an abnormality of said lock system.

12. The safe according to claim 11, further comprising:
a horizontal detecting part for detecting an inclination angle of the safe, and when the horizontal detecting part detects that an inclination exceeds a prescribed angle, said theft detecting system determines that there is an unauthorized access to said storage part.

13. The safe according to claim 12, further comprising:
a feeding part supplied with power via an external power source and a power storage part charged by the feeding part, and when a residual electric charge of the power storage part becomes lower than a prescribed amount, said theft detecting system determines that there is an unauthorized access to said storage part.

* * * * *